United States Patent [19]

VanderValk

[11] Patent Number: 4,495,263

[45] Date of Patent: Jan. 22, 1985

[54] ELECTROPHOTOGRAPHIC ELEMENTS CONTAINING POLYAMIDE INTERLAYERS

[75] Inventor: Paul D. VanderValk, Rochester, N.Y.

[73] Assignee: Eastman Kodak Company, Rochester, N.Y.

[21] Appl. No.: 509,535

[22] Filed: Jun. 30, 1983

[51] Int. Cl.[3] ..... G03G 5/14

[52] U.S. Cl. ..... 430/60; 430/58

[58] Field of Search ..... 430/66, 67, 60; 548/134, 256

[56] References Cited

U.S. PATENT DOCUMENTS

| | | | |
|---|---|---|---|
| 3,337,339 | 8/1967 | Snelling | 430/60 |
| 3,978,335 | 8/1976 | Gibbons | 430/350 |
| 4,271,293 | 6/1981 | Bremen et al. | 548/256 |
| 4,341,894 | 7/1982 | Regan et al. | 548/134 |
| 4,390,609 | 6/1983 | Wiedemann | 430/66 |

FOREIGN PATENT DOCUMENTS

| | | |
|---|---|---|
| J58063-945 | 4/1981 | Japan . |
| 58-163710 | 4/1983 | Japan . |

*Primary Examiner*—John E. Kittle
*Assistant Examiner*—John L. Goodrow
*Attorney, Agent, or Firm*—Torger N. Dahl

[57] ABSTRACT

Electrophotographic elements are disclosed containing an photoconductor layer overlying, in sequence, an electrically conducting layer, a polyamide interlayer and a support. In preferred embodiments, the element additionally comprises an integral screen layer between the support and the polyamide interlayer.

13 Claims, No Drawings

ELECTROPHOTOGRAPHIC ELEMENTS CONTAINING POLYAMIDE INTERLAYERS

The present invention relates to photoconductive elements in which an electrically conducting layer overlies a polyamide layer.

In the field of electrophotography, photoconductive elements comprising a photoconductive layer on an electrically conducting support are employed to form electrostatic images by photodecay of a uniform surface charge. The resulting electrostatic image is rendered visible by development with a suitable toner composition. Many of these photoconductive elements, however, experience an undesirable degree of nonuniformity in chargeability which ultimately passes to the copy desired in the form of nonuniform toner density. The nonuniformity is measured as the standard deviation from the desired level of charge imposed on the photoreceptor and is referred to herein as electrical granularity.

In addition to electrical granularity, PC elements containing an integral screen layer between the conducting layer and a substrate exhibit unstable sensitometry as manifested by higher dark decay, reduced chargeability and unstable initial charge (Vo). The problem is particularly noted in elements containing an integral screen composed of a regular pattern of pigmented dots in relief. With regard to the latter, the problem appears to stem in part from attack by the photoconductor coating solvents on the dots through the conducting layer, and in part from the disruption of the conductive layer by the pigmented dots.

Efforts to improve the sensitometry of screened elements, unfortunately, have been less than successful. For example, I have incorporated and studied various polymeric interlayers between the integral screen pattern and conducting layer and found that, while some polymers improved the sensitometric properties, they also exhibited undesirable levels of haze. Such levels of haze interfere with light exposures through the rear side of the element. Still other polymer interlayers studied displayed unsatisfactory coatability, and/or poor adhesion between adjacent layers. I also studied element formats in which polymeric interlayers were placed between the electrically conducting layer and the overlying photoconductive layer(s). In the latter format, problems of haze, unstable sensitometry or unsatisfactory coatability were again observed.

The foregoing problems are substantially avoided or minimized by the use of an interlayer comprising a polyamide resin having repeating units derived from caprolactam. In accordance with the present invention, therefore, an improved electrophotographic element is provided comprising a photoconductor layer overlying, in sequence, an electrically conducting layer, an interlayer of the polyamide and a support. In a presently preferred embodiment, the element comprises, in sequence, the photoconductive layer, a vacuum-deposited metal conducting layer, the polyamide interlayer, a halftone screen layer and a transparent support.

Use of the electrophotographic element of the present invention offers several advantages. For example, when the photoconductor surface of the element is charged to an initial uniform level, Vo, the standard deviation from Vo of such charge is significantly decreased compared with an otherwise identical element without an interlayer. Thus, when the element is exposed and developed in a conventional manner, the resulting image exhibits less image granularity. The element, moreover, exhibits reduced optical haze, thus providing enhanced light transmission for rear-side exposures. The adhesion of the polyamide interlayer to adjacent layers, furthermore, is high, thereby providing element integrity.

Preferred elements of the invention having an incorporated halftone screen layer, furthermore, exhibit reduced dark decay and a capability of being charged to higher and more stable initial charge levels, Vo, compared with elements without an interlayer.

The present element includes, as the photoconductive portion thereof, any of a variety of photoconductive compositions such as arylalkane leuco bases, arylamines, terphenyls, quaterphenyls, zinc oxide, selenium and the like. Preferably, one or more aggregate photoconductive layers as described, for example, in U.S. Pat. Nos. 3,615,414 and 4,350,751 are employed. An aggregate photoconductive layer comprises a co-crystalline complex of (a) a polymer having an alkylidene diarylene unit in a recurring unit and (b) at least one pyrylium dye salt. The co-crystalline complex is dispersed as a discontinuous phase in a continuous polymeric phase. Other useful types of aggregates comprise co-crystalline complexes of pyrylium dye salts with themselves or with other pyrylium dye salts.

In addition to the aggregate-containing photoconductive layer, the present invention contemplates the optional use of a charge-transport layer in electrical contact with the aggregate layer. In such embodiments, the aggregate layer is referred to by various synonyms such as a charge-generating or emitter layer.

Elements containing charge-transport layers in electrical contact with the aggregate layer are referred to in the art as multiactive. U.S. Pat. No. 4,175,960 issued Nov. 17, 1979, the disclosure of which is incorporated by reference, describes such elements.

The conducting layer of our element lies between the photoconductive layer and the polyamide interlayer. The conducting layer can comprise any one of a variety of known materials of low resistivity which will support an electrostatic field extending between the conducting layer and the outer surface of the aggregate photoconductor layer. For this reason, the conducting layer is sometimes referred to as an electrode layer. In use, the conducting layer is usually electrically grounded to facilitate charging.

In a presently preferred embodiment, the electrically conducting layer comprises a metal such as nickel or chromium vacuum-deposited on the polyamide layer sufficiently thin to allow exposure of the aggregate photoconductor layer through the support side of the element, if desired.

Vacuum-deposited conducting layers which are light-transmissive preferably have a thickness in the range from about 20 Å ($10^{-10}$m) to about 40 Å ($10^{-10}$m) so as to provide an optical density no greater than 0.4 and a resistivity of less than $8\times10^4$ Ω/square.

In accordance with the present invention, a polyamide interlayer containing repeating units derived from caprolactam is incorporated between the conducting layer and the support. Such polyamides can be made by well-known nylon-type syntheses involving, for example, alkaline polymerization of caprolactam:

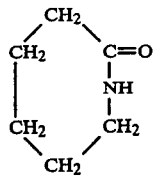

into a polyamide having recurring units of the general structure:

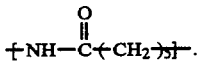

Homopolymers, commonly referred to as "nylon 6", are useful in the present invention, as well as block or random copolymers in which additional recurring units are derived from hexamethylene adipamide or hexamethylene sebacamide. Preferably, the caprolactam-derived polyamides are soluble in lower alcohols such as alcohols having 1 to 6 carbon atoms.

A preferred polyamide is poly(caprolactam-co-hexamethylene adipamide-co-hexamethylene sebacamide).

The thickness of the polyamide layer can vary widely in a sufficient amount to reduce the electrical granularity (as defined below) of the element compared with an otherwise identical element without an interlayer. A useful thickness can range from about 0.25 micrometer to about 2 micrometers when coated over an integral screen layer. If there is no screen layer, the polyamide layer thickness can be less than 0.25 micrometer.

The support for the present element underlies the polyamide layer. Opaque, as well as transparent, supports can be employed, but transparent ones are preferred to allow exposures through the support. In the latter case, conventional photographic transparent film bases such as cellulose acetate or poly(ethylene terephthalate) are useful.

Optionally, the element of the present invention contains a halftone screen layer interposed between the polyamide layer and the support. In a preferred embodiment, the screen layer is interposed between the polyamide layer and a transparent support.

The halftone screen is made up of a number of finely divided, alternating, opaque and transparent areas. The screen pattern of opaque and transparent areas may be a conventional dot pattern or line pattern of the type used for the fabrication of halftone plates for newspaper printing. The alternating opaque and transparent areas of the screen pattern may be of almost any shape, including round dots, elliptical dots, lines and the like. The spacings of the pattern may also vary so that the pattern is regular, irregular, or random. The pattern may also be varied in size from dot-to-dot or line-to-line. Particularly useful results are obtained with halftone tint screens having a frequency of about 32 to about 80 dots/cm and a percent tint, i.e., percent opaque areas, of about 10 to 90 percent.

The halftone screen layer can be applied to the support by any suitable technique such as by offset or direct gravure printing, ink jet printing or the like.

The materials employed as the screen layer can also vary, but generally any opaque material is useful. Preferred materials include pigmented inks for maximum opacity. In this regard, I have found that photoconductive elements having pigmented ink screen layers between a vacuum-deposited metal conducting layer and support exhibit undesirably high dark-decay levels. With the polyamide interlayer, however, such dark decay is substantially reduced or avoided.

The following examples are provided to aid in the practice of the present invention.

EXAMPLE 1–4

This illustrates the reduced electrical granularity of elements of the present invention. Granularity was determined as the standard deviation from an applied electrostatic charge, Vo. The element was not exposed to actinic radiation in this example.

A multiactive electrophotographic control element was prepared containing, in sequence, a 12- to 13-micrometer charge-transport layer, a 5- to 6-micrometer aggregate charge-generation layer, a 30-Å, vacuum-deposited nickel conducting layer and a 4-mil (100-micrometer) transparent polyethylene terephthalate support.

The charge-transport layer and charge-generation layer can be prepared as in Example 2 of Berwick et al U.S. Pat. No. 4,175,960.

Similar elements were prepared containing a polyamide interlayer, between the nickel layer and the support, of varied coating coverage in milligrams per meter$^2$. The polyamide employed was Elvamide 8061 (a trademark), a lower-alcohol-soluble copolyamide of caprolactam, hexamethylene adipamide and hexamethylene sebacamide.

Each of the elements was charged to a Vo of −500 volts. The standard deviation, in volts, from Vo (electrical granularity) was determined as follows: The apparatus employed contained a corona charger, a Trek Microprobe (a trademark of Trek, Inc.) for measuring small-area surface potential, and a simple holder capable of holding a film sample flat by vacuum. All measurements and steps took place in the dark.

Each of the elements was uniformly charged to a Vo of 500 volts. Portions of the charged surface 0.01 cm in diameter were measured with the microprobe at 0.005-cm spacings. After the elements were erased to 0, the procedure was repeated 5 times. From the voltage readings, the standard deviation from Vo was determined and the percentage reduction from the standard deviation of the control calculated. Results are shown in Table 1.

Examples 2–4 show reduced granularity in elements containing a polyamide interlayer compared with the control element 1.

EXAMPLES 5–8

This illustrates the reduced electrical granularity of preferred elements of the invention containing an integral screen layer between the polyamide interlayer and the support.

The control element and elements in Examples 1–4 were modified to include an integral screen layer between the Elvamide 8061 (trademark) polyamide layer and the support. The integral screen was applied by gravure-printing the support with a dioctyl-phthalate plasticized ink formulation containing the following:

| Component | Weight Percent |
|---|---|
| 1-acrylic varnish (50% solids, 50% solvent | 30 |
| 2-cellulose nitrate (40% solids, 60% solvent | 10 |

-continued

| Component | Weight Percent |
|---|---|
| 3-solvents | 10 |
| 4-pigment Bon Red (a trademark) base (21% pigment, 25% cellulose solution, 54% solvents) | 50 |

The procedure employed in Examples 1–4 was repeated. Results are shown in Table 1. The Examples 5–8 results show especially reduced granularity in integral-screen-layer elements containing a polyamide interlayer.

TABLE 1

| Example | Polyamide Interlayer Coverage ($mg/m^2$) | Integral Screen | Vo Standard Deviation | Percent Reduction from Standard Deviation of Control |
|---|---|---|---|---|
| 1 control | — | none | 1.51 | — |
| 2 | 2.32 | none | 1.17 | 23 |
| 3 | 4.65 | none | 1.11 | 26 |
| 4 | 6.97 | none | 1.27 | 16 |
| 5 control | — | yes | 2.67 | — |
| 6 | 2.32 | yes | 1.27 | 52 |
| 7 | 4.65 | yes | 1.12 | 58 |
| 8 | 6.97 | yes | 1.34 | 50 |

EXAMPLE 9

This illustrates the dark decay and chargeability, Vo, of a preferred element of the invention having both the polyamide interlayer and an integral screen layer after 36,000 and 54,000 electrical cycles, respectively. A control element without the polyamide interlayer was used for comparison.

The control element of Example 5 containing an integral screen layer but no interlayer was used. The element of Example 8 was used as the element of the invention. Each element was subjected to 36,000 and 54,000 run electrical cycles, each consisting of electrically charging to a preselected Vo and dis-charging to a preselected level. Immediately after each run, the element was recharged and the Vo measured. (In each recharging step, including the final recharging conducted after each run, the apparatus charging conditions remained unchanged.)

The initial dark decay of each element was also measured separately.

Results are shown in Table 2.

TABLE 2

| Example | Polyamide Interlayer | Initial Vo | Initial Dark Decay (picoamps/-$cm^2 \cdot sec$) | 36,000 Cycles Vo | 54,000 Cycles Vo |
|---|---|---|---|---|---|
| control | none | 550 | 568 | 515 | 510 |
| 9 | yes | 590 | 306 | 585 | 575 |

From Table 2, it can be seen that elements of the invention exhibit reduced initial dark decay and a chargeability, Vo, level after repeated cycles which varies less from the initial, Vo, of the element compared with an otherwise identical element without the polyamide interlayer.

EXAMPLE 10

This illustrates the optical haze of elements of the invention compared with otherwise identical elements with different interlayers. All elements contained an integral screen layer.

Elements were prepared having the following interlayer:

(a) Elvamide 8061 (a trademark) (as in Examples 1–9)
(b) polyurethane
(c) poly(methylacrylate-co-vinylidene chloride-co-itaconic acid)
(d) poly(vinylidene chloride-co-acrylonitrile-co-acrylic acid)
(e) cellulose nitrate Each element appeared hazy compared with the element containing the Elvamide 8061 (trademark) interlayer.

Although the invention has been described in considerable detail with particular reference to certain preferred embodiments thereof, variations and modifications can be effected within the spirit and scope of the invention.

I claim:

1. An electrophotographic element comprising a photoconductor layer overlying, in sequence, an electrically conducting layer, an interlayer comprising a polyamide having repeating units derived from caprolactam, and a support.

2. An element as in claim 1 wherein said polyamide also comprises repeating units derived from one or both of hexamethylene adipamide and hexamethylene sebacamide.

3. An element as in claim 1 wherein said photoconductor layer comprises an aggregate photoconductor.

4. An element as in claim 3 wherein a charge-transporting layer overlies said aggregate photoconductor layer.

5. An element as in claims 1 or 2 wherein said electrically conducting layer is a transparent metal layer.

6. An element as in claim 5 wherein said metal layer is vacuum-deposited.

7. An electrophotographic element comprising a photoconductor layer overlying, in sequence, an electrically conducting layer, an interlayer comprising a lower-alcohol-soluble polyamide having repeating units derived from caprolactam, an integral screen layer, and a support.

8. An element as in claim 7 wherein said integral screen layer comprises a plurality of pigmented dots extending in relief from said support.

9. An element as in claims 7 or 8 wherein said polyamide also comprises repeating units derived from one or both of hexamethylene adipamide and hexamethylene sebacamide.

10. An element as in claims 7 or 8 wherein said photoconductor layer comprises an aggregate photoconductor.

11. An element as in claim 10 wherein a charge-transporting layer overlies said aggregate photoconductor layer.

12. An element as in claims 7 or 8 wherein said electrically conducting layer is a transparent metal layer and said support is transparent.

13. An element as in claim 12 wherein said metal layer is vacuum-deposited.

* * * * *